US007849531B2

(12) United States Patent
Rooke et al.

(10) Patent No.: US 7,849,531 B2
(45) Date of Patent: Dec. 14, 2010

(54) CONFIGURABLE SHOWER SYSTEM

(75) Inventors: Georgina E. Rooke, London (GB); Cheryl Furtak, Birmingham, MI (US); Keith A. Grider, Columbus, OH (US); Mark D. Begin, Madison, WI (US); Frank J. Wilgus, Ostrander, OH (US); Geoff Rooke, Treillieres (FR)

(73) Assignees: Sculptured Homes, LLC, Birmingham, MI (US); Sculptured Homes Limited, London (GB)

( * ) Notice: Subject to any disclaimer, the term of this patent is extended or adjusted under 35 U.S.C. 154(b) by 449 days.

(21) Appl. No.: 11/856,388

(22) Filed: Sep. 17, 2007
(Under 37 CFR 1.47)

(65) Prior Publication Data

US 2008/0127409 A1 Jun. 5, 2008

Related U.S. Application Data

(63) Continuation-in-part of application No. 10/935,143, filed on Sep. 7, 2004, now Pat. No. 7,269,862.

(51) Int. Cl.
*A47K 3/022* (2006.01)

(52) U.S. Cl. ..... 4/614; 4/612; 4/524

(58) Field of Classification Search ..... 4/611–614, 4/524, 525

See application file for complete search history.

(56) References Cited

U.S. PATENT DOCUMENTS

| | | | | |
|---|---|---|---|---|
| 1,017,167 | A | 2/1912 | Pleins | |
| 2,096,024 | A * | 10/1937 | Anderson | 248/301 |
| 3,007,178 | A | 11/1961 | Altman et al. | |
| 3,142,513 | A * | 7/1964 | Skokut | 4/611 |
| 3,462,771 | A | 8/1969 | Moretti | |
| 3,551,918 | A | 1/1971 | Bergmark | |
| D238,490 | S | 1/1976 | Blitch | |
| D253,672 | S | 12/1979 | Baus et al. | |
| 4,189,790 | A | 2/1980 | Masters, III | |
| 4,361,915 | A | 12/1982 | Siewert | |
| D286,173 | S | 10/1986 | Baus et al. | |
| D297,157 | S | 8/1988 | Eder | |
| 4,987,619 | A | 1/1991 | Smith | |

(Continued)

FOREIGN PATENT DOCUMENTS

| | | |
|---|---|---|
| DE | 3737313 | 5/1989 |

(Continued)

OTHER PUBLICATIONS

Clarke Products Inc., Grand Prairie Texas: Large Colorfloors® for spacious showers, item SB4234, 1993. D23/283 NPL patent shoe.

(Continued)

*Primary Examiner*—Khoa D Huynh
(74) *Attorney, Agent, or Firm*—Honigman Miller Schwartz & Cohn LLP

(57) ABSTRACT

A shower system is provided that includes first and second panels that at least partially defining a shower space. The shower system also includes a basin sized to receive a lower edge of the first and second panels such that the panels are arrangeable with respect to the basin in one of at least two configurations.

16 Claims, 12 Drawing Sheets

U.S. PATENT DOCUMENTS

| | | | | |
|---|---|---|---|---|
| D321,755 | S | 11/1991 | Poulson et al. | |
| 5,255,399 | A | 10/1993 | Park et al. | |
| D346,015 | S | 4/1994 | Maskell et al. | |
| D351,019 | S | 9/1994 | Moore et al. | |
| 5,542,218 | A | 8/1996 | Rompel | |
| D380,528 | S | 7/1997 | D'Andrea et al. | |
| 5,642,959 | A | 7/1997 | Greferath et al. | |
| D385,019 | S | 10/1997 | Sadler et al. | |
| D389,232 | S | 1/1998 | Pangowski | |
| 5,732,421 | A | 3/1998 | Scherberger | |
| D406,328 | S | 3/1999 | Speirs et al. | |
| 6,003,169 | A | 12/1999 | Davis, Jr. | |
| 6,301,725 | B1 | 10/2001 | Harvey | |
| 6,363,547 | B1 | 4/2002 | Perry | |
| 6,443,164 | B1 | 9/2002 | Parker et al. | |
| 6,640,354 | B2 * | 11/2003 | Bonack et al. | 4/611 |
| 6,675,403 | B2 | 1/2004 | Akhtar et al. | |
| 6,698,037 | B2 | 3/2004 | Lippe et al. | |
| 2004/0003459 | A1 | 1/2004 | Ferreri et al. | |
| 2004/0034922 | A1 | 2/2004 | Grayson | |
| 2004/0068789 | A1 | 4/2004 | Pastorelli | |

FOREIGN PATENT DOCUMENTS

| | | |
|---|---|---|
| DE | 29608819 | 5/1996 |
| DE | 20020711 | 12/2000 |
| EP | 1329183 | 4/1998 |
| EP | 1155649 | 4/2001 |
| EP | 1212970 | 11/2001 |
| GB | 2122076 | 6/1982 |
| GB | 2406513 | 4/2005 |
| WO | WO-99/43248 | 2/1999 |

OTHER PUBLICATIONS

Kohler Online Catalog, Purist Wet Surface lavatory K-2313 (2 pages).

Acorn Engineer Co., Jun. 1, 2002, pate T.SBIS-Terrazzo-Ware Shower Base-Institutional Series SBIS-36-RAB.

Acorn Engineer Co., Jun. 1, 2002, pate T.SBBOD-Terrazzo-Ware Shower Base-Back Outlet Series SBS-36-BOD-FF.

* cited by examiner

CONFIGURABLE SHOWER SYSTEM

CROSS-REFERENCE TO RELATED APPLICATIONS

This application is a continuation-in-part of application Ser. No. 10/935,143 filed Sep. 7, 2004, now U.S. Pat. No. 7,269,862, issued Sep. 18, 2007, which claims priority to U.S. provisional application 60/501,773 filed on Sep. 10, 2003, which is incorporated herein by reference in its entirety.

FIELD OF THE INVENTION

The present invention relates to a shower system and more particularly to a configurable shower system.

DESCRIPTION OF THE RELATED ART

Showers or shower areas, if they are integrated into larger rooms such as bathrooms and the like, typically require enclosures to prevent the shower water (wastewater and splashing water) from entering the room around it. In a particular implementation, the shower enclosure is placed in the corner of a room, or in some especially partitioned-off portion of the room, which requires some integration of the shower enclosure into the room itself. While these designs have proven effective for the non-discriminating consumer, many consumers demand a more architecturally or aesthetically appealing enclosure or showering atmosphere. Although many contemporary shower designs incorporate aesthetically pleasing materials, functional hardware, and architecture into the showing environment, these shower designs are typically custom enclosures designed by architects or interior designers on a case-by-case basis and accordingly, they do not provide a universal shower system capable of multiple configurations. Accordingly, there is a need for a modular shower system that enables shower panels to be arranged in one of two (or more) possible configurations relative to a shower basin which results in an aesthetically appealing shower enclosure and is versatile enough to accommodate various environments and consumer tastes while retaining functional integrity.

SUMMARY OF THE INVENTION

A shower system is provided that includes first and second panels and a basin. The basin includes a channel sized to receive a lower edge of the first and second panels such that the first and second panels are configurable in one of at least two possible configurations with respect to the basin.

In another embodiment of the invention, a shower system is provided that includes a configurable enclosure including two or more panels and a prefabricated wet wall referred to herein as a splash panel module including at least one piece of shower hardware. The shower system also includes a basin having a first channel sized to receive a lower edge of the panels and the splash panel module. The panels and splash panel module are configurable with respect to the basin in at least one functional arrangement. An upper frame of the shower system includes a channel sized to fit over an upper edge of the panels and the splash panel module. The shower system also includes an optional ceiling module supported by the upper frame.

BRIEF DESCRIPTION OF THE DRAWINGS

Embodiments of the invention will now be described, by way of example, with reference to the accompanying drawings, wherein.

DETAILED DESCRIPTION

Figure 1:
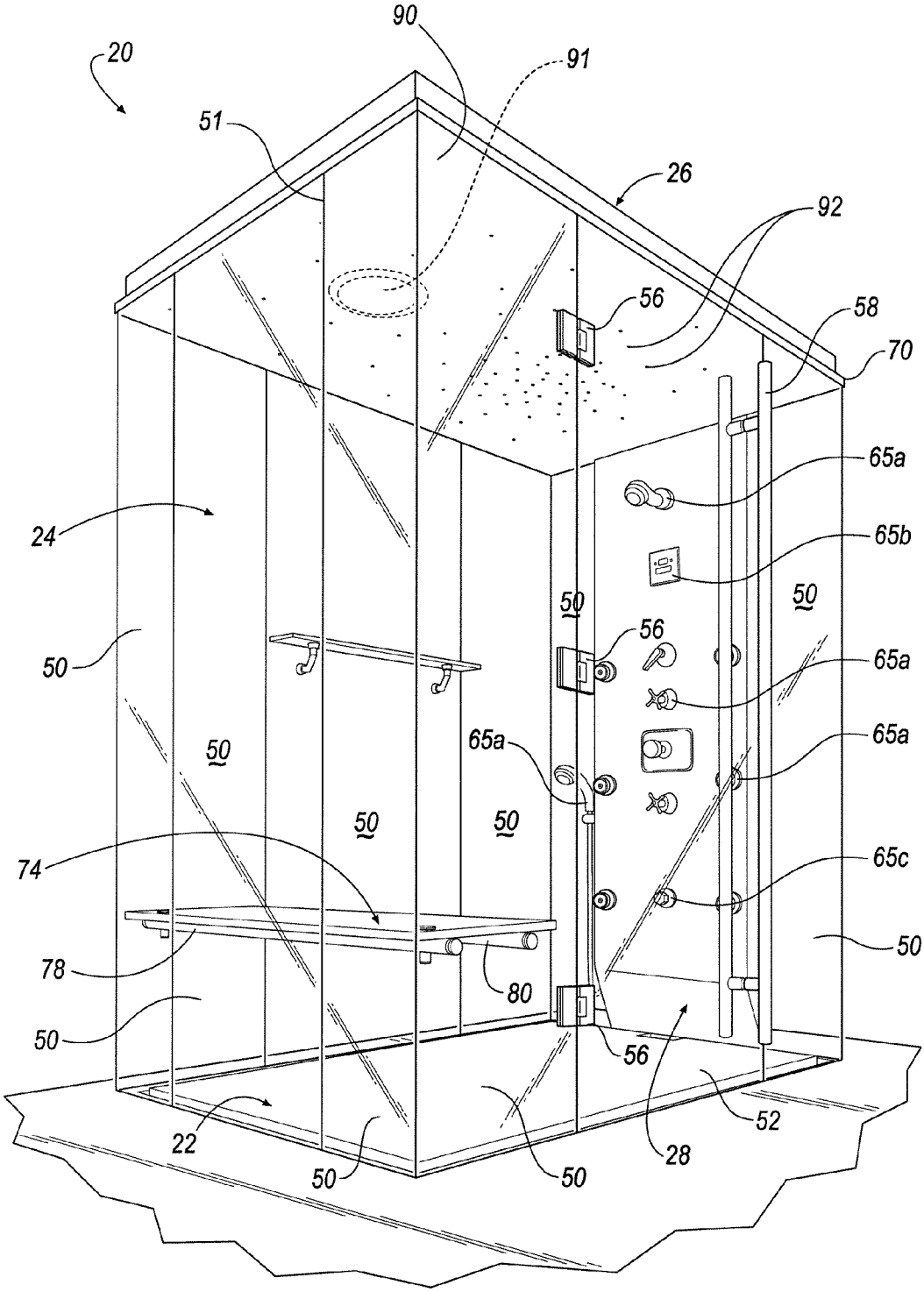
FIG. 1 is a perspective view of a shower system according to an embodiment of the present invention.

Referring now to the drawings, the preferred illustrative embodiments of the present invention are shown in detail. Although the drawings represent some preferred embodiments of the present invention, the drawings are not necessarily to scale and certain features may be exaggerated to better illustrate and explain the present invention. Further, the embodiments set forth herein are not intended to be exhaustive or otherwise limit or restrict the invention to the precise forms and configurations shown in the drawings and disclosed in the following detailed description.

With reference to FIG. 1, a shower system 20 according to an embodiment of the present invention is shown. In the illustrated embodiment, shower system 20 is depicted as a "stand alone" unit; however, as will be appreciated, a portion of shower system 20 may be integrated into one or more walls of a room or structure.

As shown in FIG. 1, an embodiment of shower system 20 generally includes a basin 22 (also known as a shower pan), a configurable enclosure 24, a ceiling module 26 and a splash panel module 28, which may be collectively referred to herein as the "components." These components at least partially define a shower area (or shower space). As will be discussed in detail below, the modularity of system 20 allows some or all of the components to be arranged in one of several different configurations to accommodate the environment in which system 20 is installed or the particular taste of the user.

Referring to FIGS. 2-7, an embodiment of basin 22 is shown in detail. In the illustrated embodiment, basin 22 includes a generally rectangular body 30 having an outer periphery 32, a top surface 34 and a bottom surface 36. While basin 22 is illustrated as being generally rectangular in shape, it is not necessarily limited thereto.

Figures 2, 3, 4:
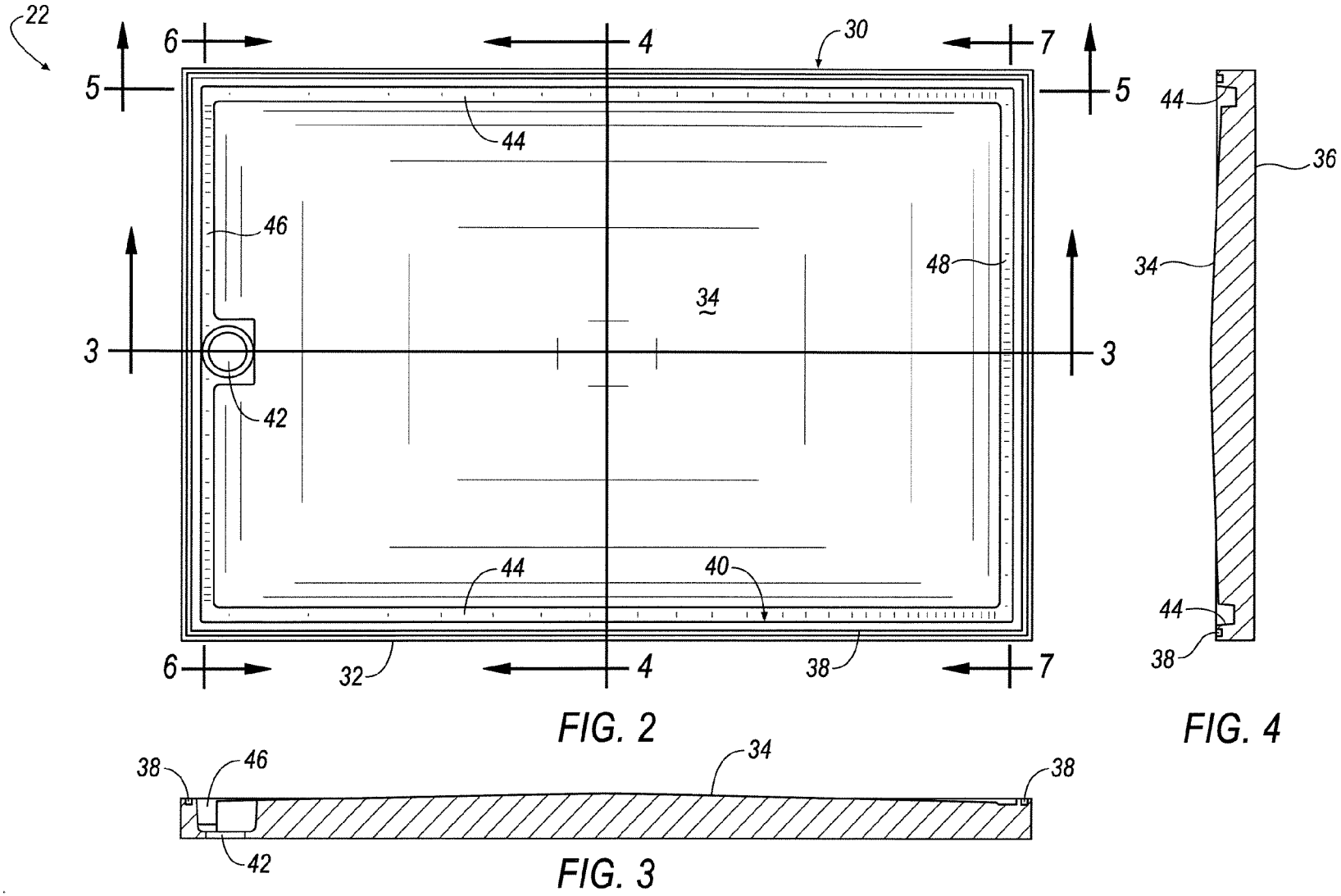
FIG. 2 is a top view of a shower basin according to an embodiment of the present invention.
FIG. 3 is a cross-sectional view of the shower basin of FIG. 2 taken along lines 3-3.
FIG. 4 is a cross-sectional view of the shower basin of FIG. 2 taken along lines 4-4.

Inward of outer periphery 32 is disposed a first channel 38 that extends from top surface 34 and is configured to receive a lower edge of enclosure 24 and optional splash panel module 28. As shown in the embodiment of FIG. 2, first channel 38 boarders the entire outer periphery 32. However, in shower systems that are partially integrated into a wall or other structure, first channel 38 may be positioned around only a portion of basin 22.

Figure 5:
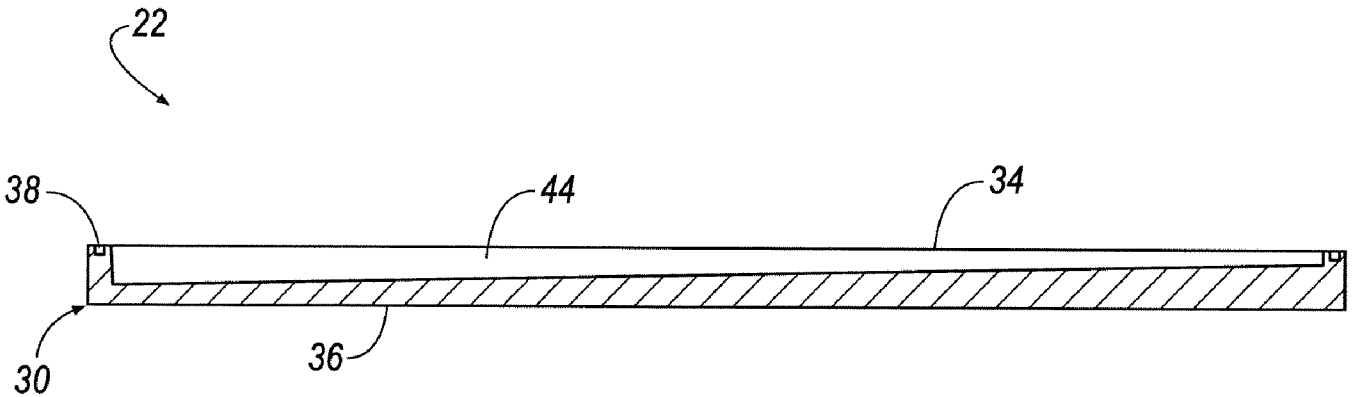
FIG. 5 is a cross-sectional view of the shower basin of FIG. 2 taken along lines 5-5.
Figure 6:
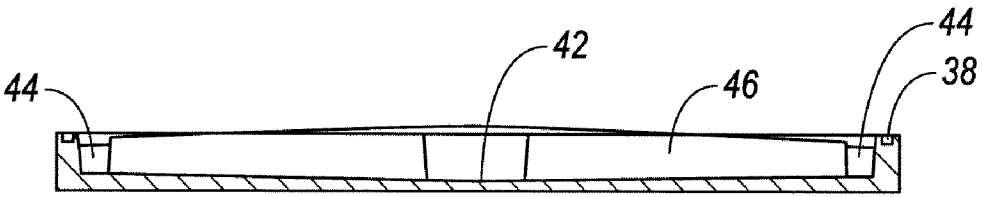
FIG. 6 is a cross-sectional view of the shower basin of FIG. 2 taken along lines 6-6.
Figure 7:
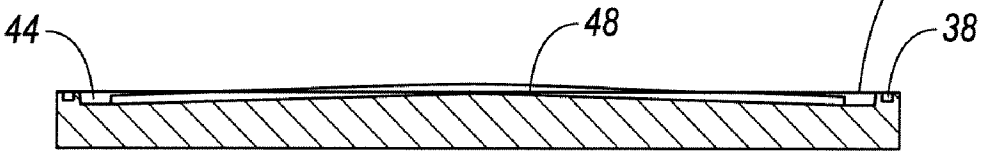
FIG. 7 is a cross-sectional view of the shower basin of FIG. 2 taken along lines 7-7.

Referring still to FIGS. 2-7, basin 22 includes a second channel 40 that also extends from top surface 34. Second channel 40 is configured to collect water run-off from top surface 34 and enclosure 24 and directs the run-off toward a drain 42. In the illustrated embodiment, second channel 40 includes side components 44, a first end component 46 proximate drain 42 and a second end component 48 at an end of basin 22 opposite first end component 46. With reference to FIG. 5, side components 44 of second channel 40 are sloped in a direction toward first end component 46 to direct the collected water toward drain 42. First end component 46 is slightly graded from side components 44 inward, as shown in FIG. 6, to direct the collected water from side components 44 into drain 42. As shown in FIG. 7, second end component 48 is slightly graded from the middle of basin 22 outward to direct the collected water into side components 44 of channel 40. Top surface 34 may be slightly convex or otherwise graded in one or more directions to direct water into second channel 40.

As noted above, system 20 may be installed in a room or structure as a free-standing unit or at least partially integrated into the room or structure. Accordingly, basin 22 may be installed such that the portion of top surface 34 adjacent periphery 32 is substantially flush with the floor into which basin 22 is installed, as shown in FIG. 1, or slightly sunken into the floor such that a user must step down into basin 22 upon entry (not shown). Because basin is configured to channel the water around the top surface 34, basin 22 may be relatively thin. This feature permits installation of basin 22 below the surface of a floor without significant intrusion into the sub-floor joists or support structure. Alternatively, basin 22 may be installed in a room or structure such that it is raised above the floor, requiring a user to step up into the basin upon entry.

Among other manufacturing techniques, basin 22 may be made from a molded resin composite. Top surface 34 may be tiled, painted, textured or otherwise decorated to blend with the surrounding floor, or installed "as is" to retain the existing solid surface finish.

In an embodiment of the invention, configurable enclosure 24 includes a number of panels 50 configured to be received in first channel 38 of basin 22. A water-resistant sealing material 51, such as silicone caulking or the like may be disposed between each panel 50 when installed in basin 22. In a particular implementation, panels 50 are tempered glass having a thickness slightly less than or equal to the width of first channel 38. First channel 38 and panels 50 may also be sized such that an interference fit is created there between to seal panels 50 within first channel 38. A water-resistant sealing material may also be disposed between basin 22 and panels 50 to create a water tight seal.

Figure 8:
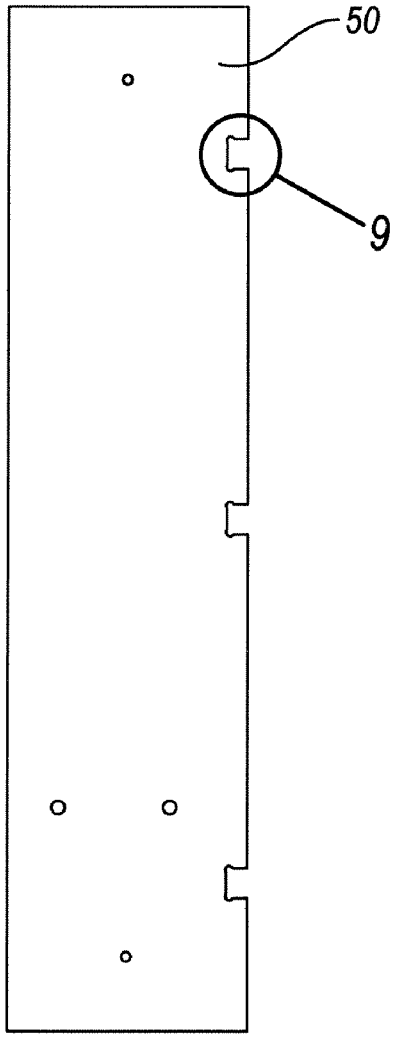
FIG. 8 is an elevation view of a configurable enclosure panel including a hinge slot.
Figure 9:
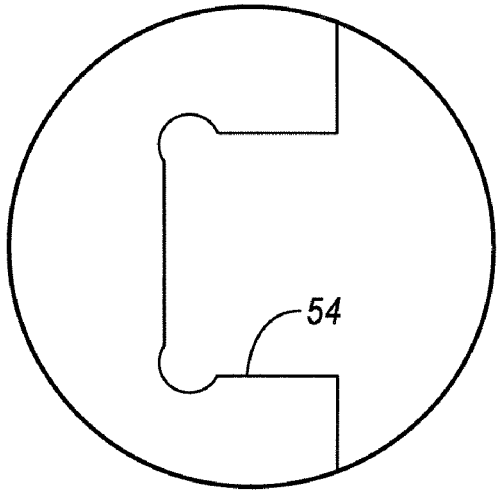
FIG. 9 is a detailed view of a hinge slot shown in FIG. 8.

In an embodiment, configurable enclosure 24 may also be provided with a moveable door panel 52. When so configured, a panel 50 adjacent door panel 52 may include one or more cut-out features 54 for attaching a door hinge 56 (see, e.g., FIGS. 8 and 9). A handle 58 may be attached to the inside and/or outside of door panel 52 to assist a user in moving door panel 52. Optionally, decorative corner panels 60 (see, e.g., FIG. 10) or other decorative trim panel(s) may be attached to corresponding panels 50 by a number of rigid stand-off members 62.

Figure 10:
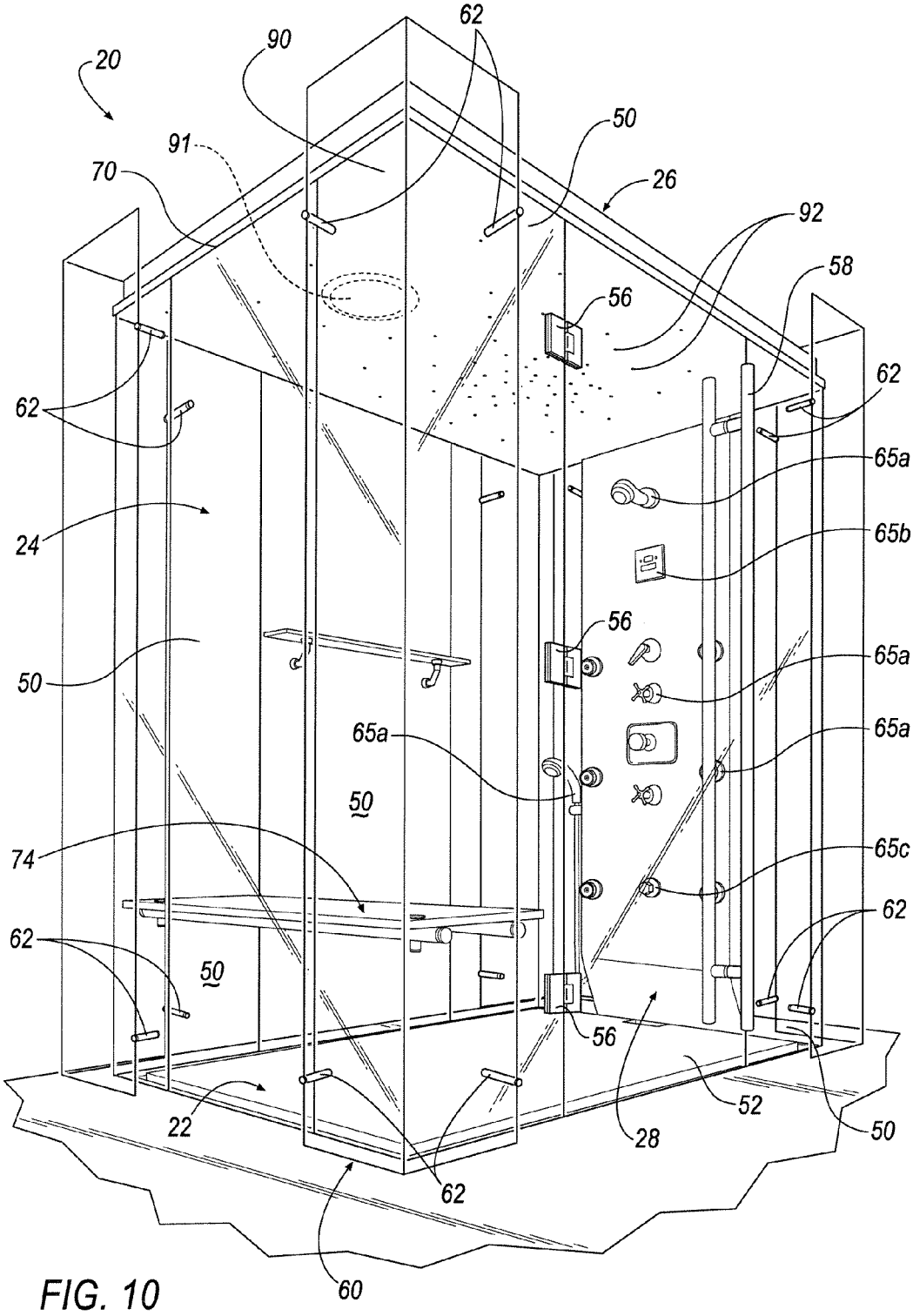
FIG. 10 is a perspective view of a shower system according to another embodiment of the present invention.
Figure 11:
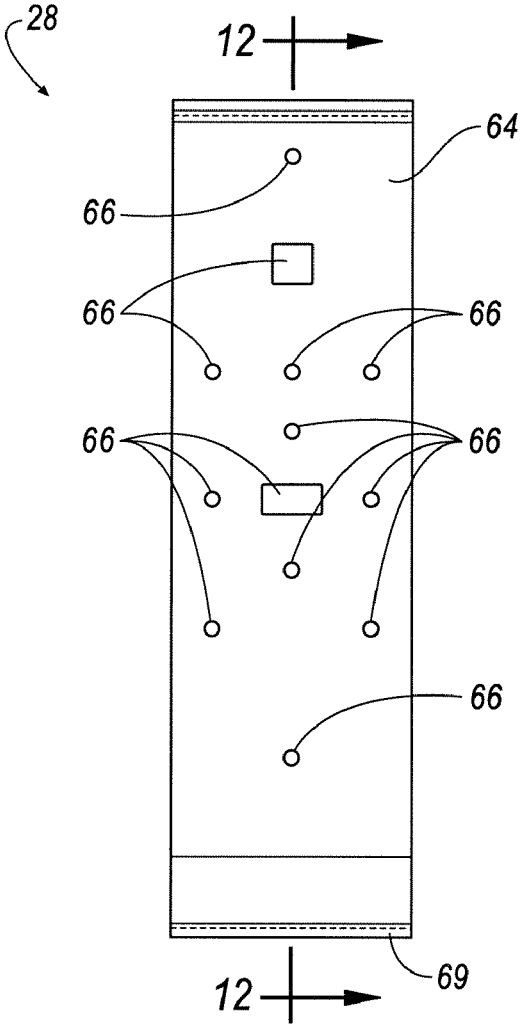
FIG. 11 is a front elevation view of a splash panel module according to an embodiment of the present invention.
Figure 12:
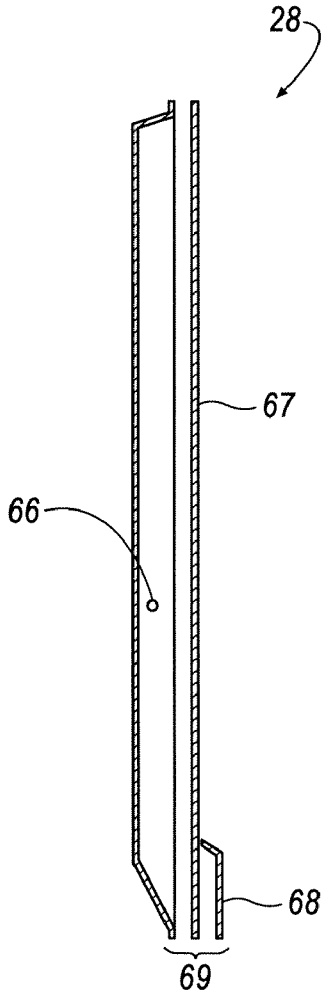
FIG. 12 is a cross-sectional, exploded view of the splash panel module of FIG. 11.

Referring to FIGS. 11 and 12, an embodiment of splash panel module 28 is shown. Splash panel module 28 includes a housing 64 and holes 66 for water distribution hardware. In an embodiment, splash panel module 28 houses the plumbing and fixtures for the water distribution hardware. The fixtures (shown generically in FIGS. 1 and 10 as elements 65A) may include, for example, body jets, head and hand shower units and accompanying water regulation hardware (see, e.g., FIG. 1). Fixtures for distribution of steam (65B) and aromatherapy materials (65C) may also be incorporated into module 28. The term "shower system," as used herein, includes arrangements of some or all of the shower system components to provide, among other things: (i) water distribution alone; (ii) water, steam and/or aromatherapy distribution; or (iii) steam and/or aromatherapy distribution alone.

When installed as a free-standing shower system, splash panel module 28 may include a back cover plate 67 (FIG. 12) that conceals the plumbing for the water distribution hardware. When so configured, one or more water pipes are all that protrude from module 28 to allow a plumber to easily install the module to water supply lines. The exposed water pipes may be covered by a pipe cover 68 (FIG. 12) styled to match the décor of splash panel module 28.

Figure 13:
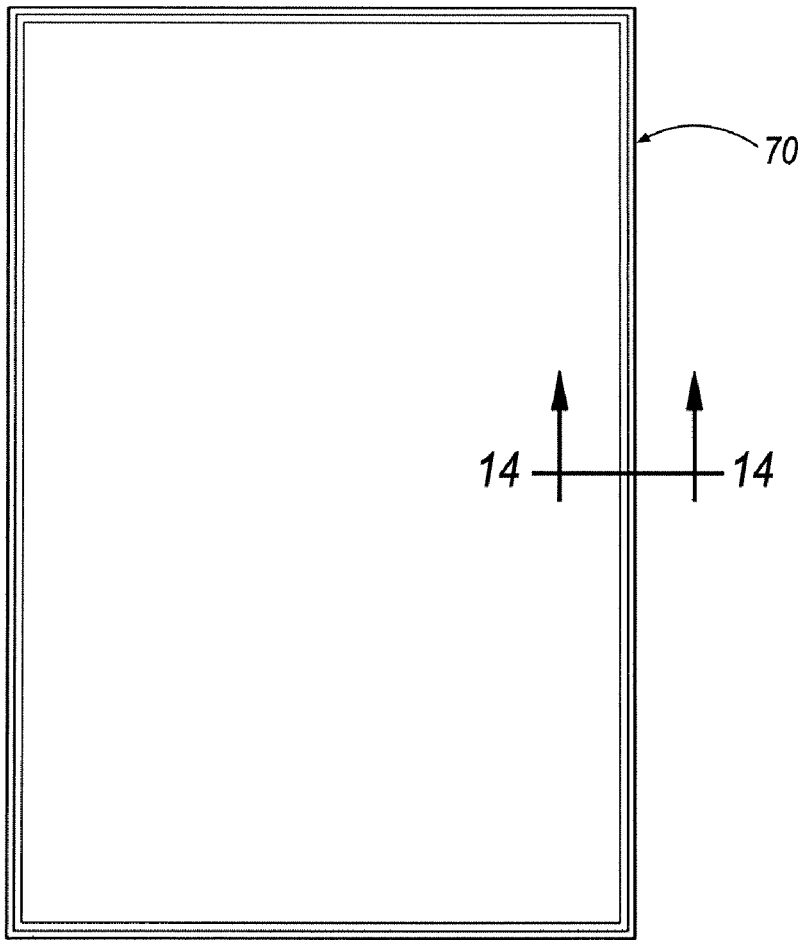
FIG. 13 is a top view of a frame member according to an embodiment of the present invention for use in securing the top portion of the configurable enclosure.
Figure 14:
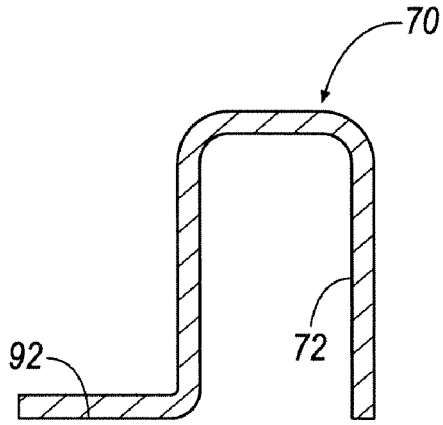
FIG. 14 is a cross-sectional view of the frame member of FIG. 13.

The lower edge of splash panel module 28 is configured to be received in first channel 38 of basin 22. For example, housing 64 incorporates a lip 69 sized for receipt in first channel 38. A sealing material, such as silicone caulking, may be disposed between splash panel module 28 and adjacent panels 50 when installed in basin 22. An upper frame 70 is placed over an upper edge of panels 50 and module 28. As shown in FIGS. 13 and 14, upper frame 70 is generally U-shaped in cross-section having an inner channel 72 sized to receive an upper edge of panels 50 and module 28.

Figure 15:
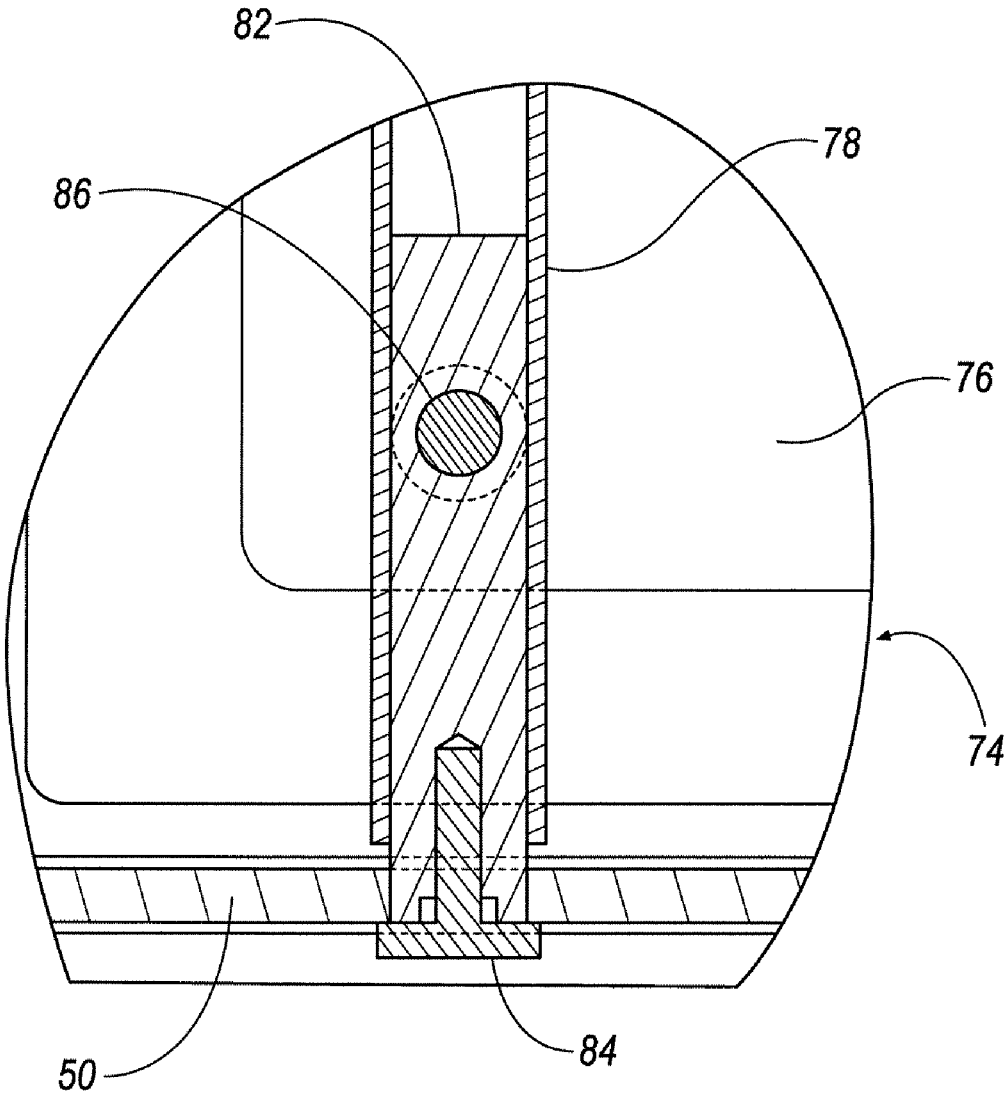
FIG. 15 is a detailed cross-sectional view of a shower seat mount for attaching the suspended shower seat shown in FIGS. 1 and 10 to the configurable enclosure.

Referring to FIGS. 1, 10 and 15, a seat 74 for use in shower system 20 is shown. In the illustrated embodiment, seat 74 includes a seat member 76 that is moveably supported by a pair of support members 78, 80. A first support member 78 is attached to seat member 76 and is rotatable relative to panels 50 between which first support member 78 is supported. In a particular configuration, first support member 78 is a tubular member that includes a generally cylindrical hinge pin 82 inserted in each end thereof. Hinge pins 82 extend into a hole in panels 50 and are secured to panels 50 by a cap 84. Seat member 76 is attached to first support member 78 by a bolt 86 that extends through seat member 76, first support member 78 and hinge pin 82. Hinge pins 82, first support member 78 and seat member 76 are therefore rotatable about an axis that extends through first support member 78 and hinge pins 82. Second support member 80 is fixedly secured to panels 50 and functions to help support the weight of seat member 76 when seat member is rotated downward to a generally horizontal position. In addition to the embodiment shown in FIGS. 1 and 10, it will also be appreciated that seat 74 may be non-movably secured in configurable enclosure 24. It is also contemplated that suspended seat member can be attached to one, and only one, panel 50 such that it is cantilevered therefrom.

Figure 16:
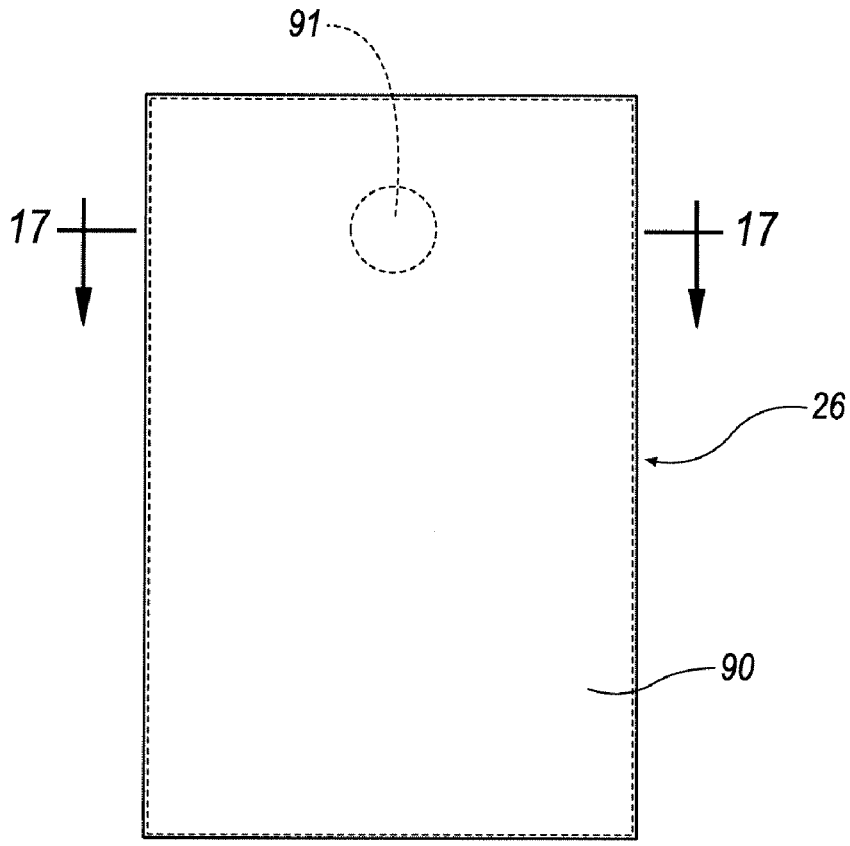
FIG. 16 is a top view of a ceiling module according to an embodiment of the present invention.
Figure 17:
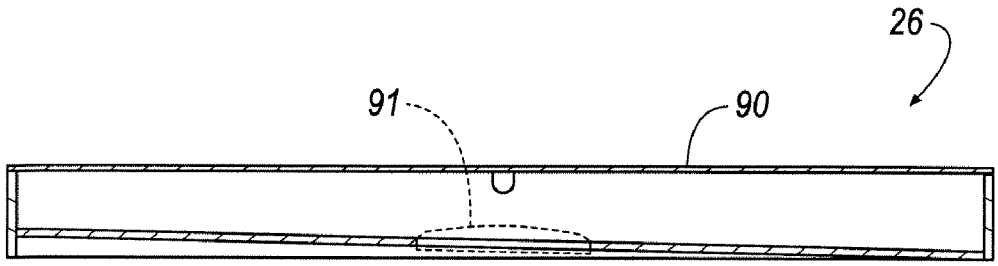
FIG. 17 is a cross-sectional view of the ceiling module of FIG. 16.

Referring to FIGS. 16 and 17, an embodiment including an optional ceiling module 26 is shown. In the illustrated embodiment, ceiling module 26 includes a housing 90 that is supported over configurable enclosure 24 by a flange 92 on upper frame 70 (see FIG. 14). Housing 90 may be made of a lightweight, moisture resistant material, such as acrylic or other suitable plastics. When shower system 20 is provided with steam generating capability, the interior surface of ceiling module 26 may have a slight grade in one or more directions to direct water roll off for drainage (see, e.g., FIG. 17).

Optionally, housing 90 may be configured to include one or more audio and/or visual components. For example, housing can be configured to include a speaker or speaker system 91 for supplying music and other sounds to the interior of enclosure 24. In another example, housing may be configured to include one or more light producing devices, such as a lamp, LED or fiber optic display. Any electrical wiring needed to power the audio and/or visual components in ceiling module 26 may be routed out of ceiling module 26 through a sleeve or flexible conduit into splash panel module 28 and then out to the power and/or communication source. One or more communication interface devices, such as a wire harness or electrical connector, may be employed between ceiling module 26 and splash panel module 28 to facilitate installation of shower system 20.

As will be appreciated, the modularity of shower system 20 makes it readily configurable to accommodate various environments and tastes. More particularly, the design of basin 22 allows shower system 20 to be installed flush with a floor for a substantially smooth transition between the top surface 34 of basin 22 and the surrounding floor, below the floor surface, or above the floor surface without significant modification to conventional sub-floor structures. Furthermore, the manner in which panels 50 and splash panel module 28 are connected with basin 22 allow panels 50 and module 28 to be arranged in different configurations. For example, with reference to FIG. 1, door panel 52 could easily be installed on the opposite side of system 20 by simply rearranging two or more panels 50 and door panel 52. In a similar example, splash panel module 28 could be installed on an end of basin 22 opposite drain 42.

As will also be appreciated, splash panel module 28 and ceiling module 26 may be manufactured with customized hardware configurations, or may be offered with standard hardware packages. Accordingly, the audio/visual and water distribution hardware requirements of a particular shower system 20 can be accommodated by merely substituting different splash panel module 28 and ceiling module 26 configurations without modifying the remaining components in system 20, i.e., basin 22 and configurable enclosure 24.

Figure 18:
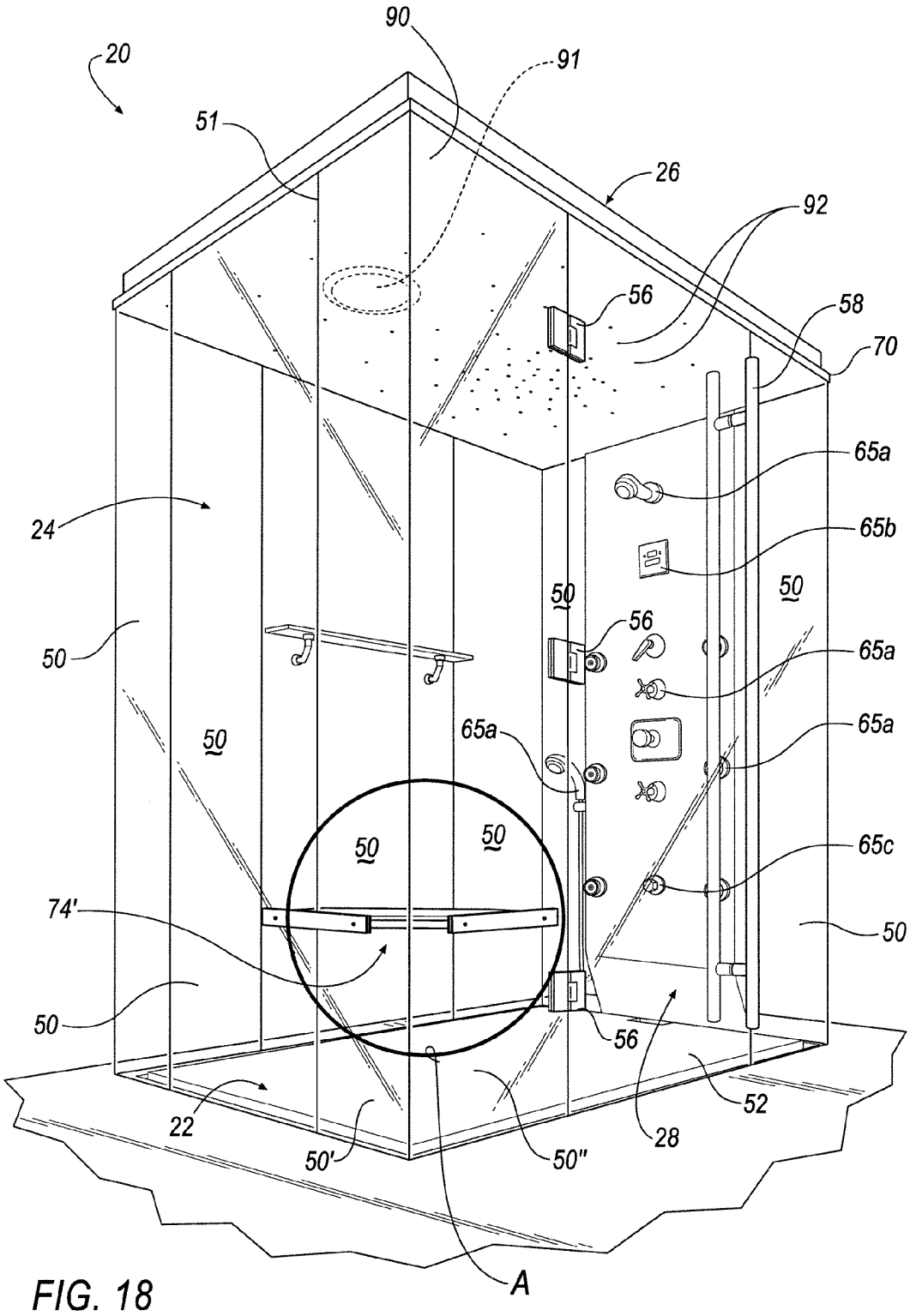
FIG. 18 is another embodiment of the shower system of FIG. 1 wherein the seat 74' is a suspended corner seat.

Now referring to FIGS. 1 and 18, in FIG. 1, seat 74 can more specifically be described as a suspended bench style seat which spans two opposing (or parallel) wall panels. "Suspended" as the term is used herein means a seat that is supported by, and only by, one or more panels 50. In an alternative embodiment, FIG. 18 shows seat assembly 74', more specifically suspended seat assembly, which spans two adjoining corner walls 50', 50" to form corner seat assembly 74'.

Figure 19:
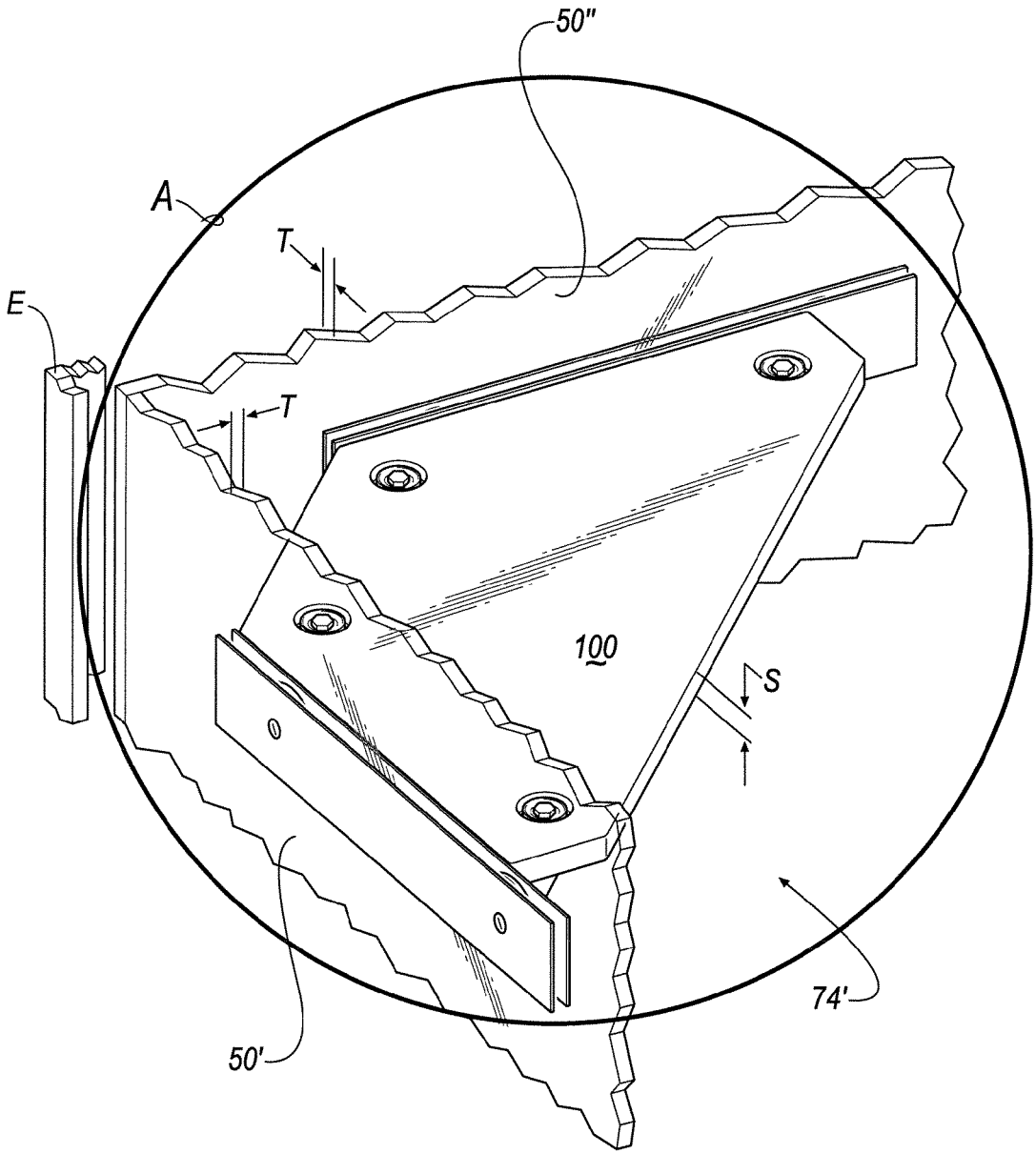
FIG. 19 is an enlarged isometric view of encircled portion A of FIG. 18.

Now referring to FIGS. 18, and 19, corner seat assembly 74' includes, in part, seat platform 100. Seat platform 100 may be supported (at least indirectly) by adjacent corner panels 50', 50". Although any number of materials can be used to fabricate seat platform 100, and panels 50, 50', it is contemplated that these items could be fabricated from float glass. Float glass having a thickness T in the range of ¼ inch through ½ inch, typically ⅜ inch, will be of sufficient thickness to provide the load bearing strength needed by panels 50', 50". It is also contemplated that a float glass thickness S of ¾ inch will be sufficiently thick to accommodate the load bearing forces that will be exposed to seat platform 100 during normal use. One advantage of using float glass having a thickness T of ¼ inch or more, is that it gives panels 50', 50" sufficient strength to bear the loads they will be subjected to under normal use without acquiring the use of an edge frame E member. Of course, an edge frame member E can be used even if it is not required by the structural demands placed on panels 50', 50" (for example, may be aesthetically desirable to frame the corner portions of enclosure 20).

Panels 50', 50" and seat platform 100 may be left uncoated (in their natural state), or they may, alternatively be coated using any number of coatings. It is contemplated that painting one or both sides of panels 50', 50", and seat platform 100 might be a desirable option. It is also contemplated that if panels 50', 50" and seat platform 100 is made of float glass, ceramic frit (or other suitable alternative coatings) can be used to coat one or more sides of panels 50', 50", and seat platform 100. Ceramic frit is available in a variety of colors and can be used to harmonize the color scheme used throughout the enclosure. Ceramic enamel frits contain finely ground glass mixed with inorganic pigments. The frit is deposited onto the glass and the coated glass is then heated to approximately 1150° Fahrenheit thereby fusing the frit to the glass surface. The fused frit produces a ceramic coating which is almost as hard and tough as the float glass itself. A fired ceramic frit is durable and resists damage caused by abrasion and most chemicals.

Figure 20:
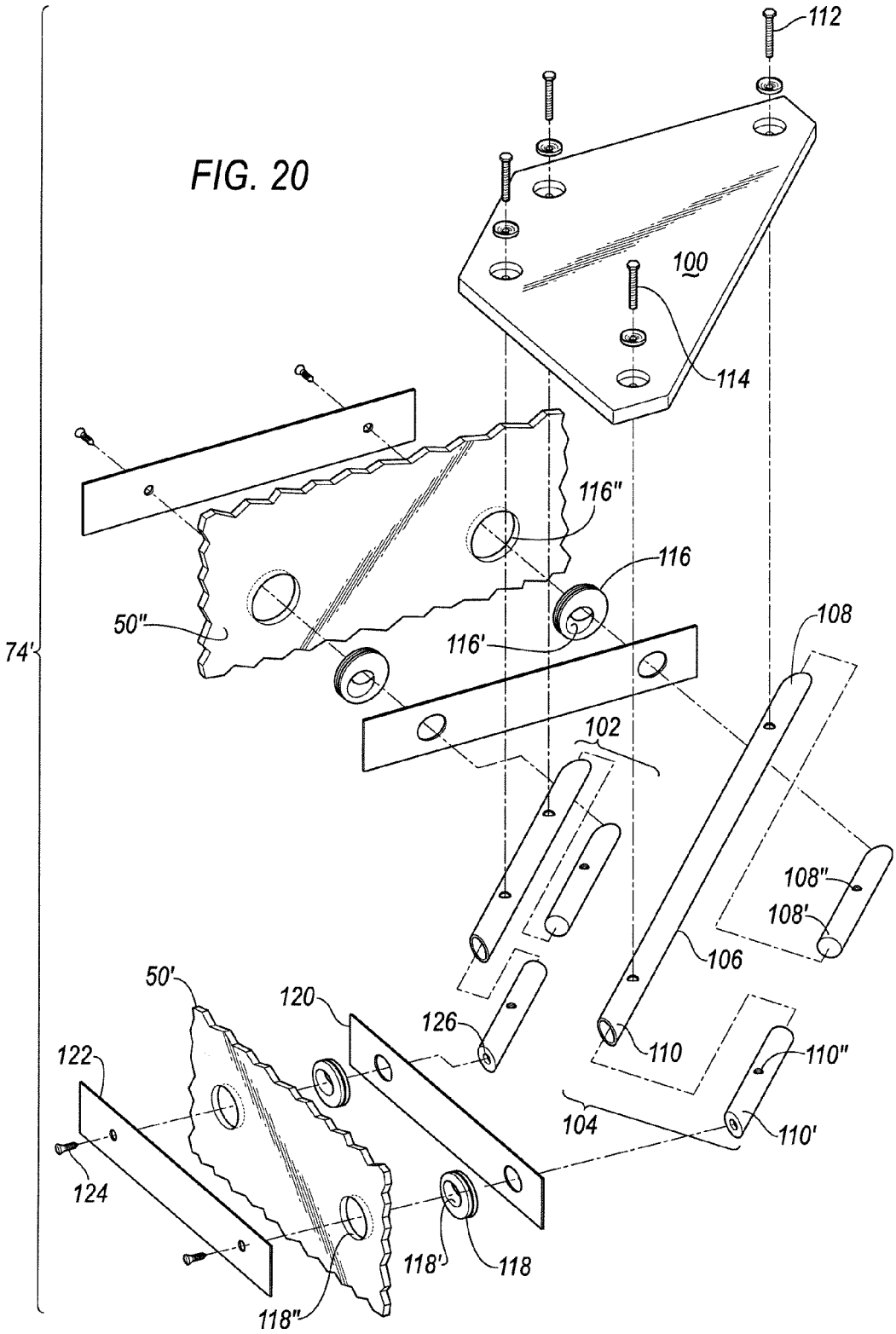
FIG. 20 is an exploded view of the corner seat of FIG. 19.

Now referring to FIG. 20, corner seat assembly 74' includes corner seat 100 that is directly supported (under-girded) by one or more support assemblies. The one or more support assemblies may include a rear support assembly 102 and a front support assembly 104. Front support assembly 104 may include a long brace member 106 having first and second end portions 108, 110. End portions 108, 110 may have a tubular (hollow) geometry so that they can telescopically receive therein, respectively associated mounting post 108', 110'. Mounting posts 108', 110' may include a vertical threaded opening 108", 110" to receive a respectively associated threaded fastener 112, 114 to securely fasten corner seat platform 100 to front support assembly 104. Rear support assembly 102 can be fabricated in the identical manner as that described for front support assembly 104.

Front support assembly 104 is anchored to corner panels 50', 50" by way of respectively associated inserts 118, 116. Inserts 118, 116 include respectively associated openings formed therein 118', 116' for receiving an end portion of respectively associated mounting post 110', 108'.

Although it is contemplated that inserts 116, 118 could have outer contours defined by any number of geometries, it is contemplated that a circular-cylindrical outer surface geometry is beneficial because it allows for a respectively associated circular hole 116", 118" formed in respectively associated panel 50", 50' to engagingly receive respectively associated insert 116, 118 thereby providing a load bearing surface for supporting load placed on corner seat platform 100. It is evident from FIG. 20 that if inserts 116, 118 are formed in the shape of circular disks, opening 116', 118' will intersect a surface of its respectively associated disk such that the edge formed by the opening and the disk forms an ellipse. The identical components and mounting procedure can be used to mount rear support assembly 102 to panels 50', 50" and accordingly no further discussion is necessary. Inserts 116, 118 can be secured within their respective openings 116", 118" using any number of mounting techniques (such as adhesives and the like). However, it may be desirable to sandwich inserts 116, 118 between an inside plate and an outside plate (for example see inside plate 120 and outside plate 122). Plates 120, 122 provide a system for ensuring that inserts 116, 118 will not become dislodged from their respectively associated panel openings 116", 118". Also, plates 120, 122 can be sealed (using silicone, gaskets, or other sealing mediums) against panels 50', 50" to prevent water leakage through openings 116", 118". Threaded fasteners can be used to engage threaded openings formed in an end portion of the mounting posts (see fastener 124 and threaded opening 126) thereby forming a system for tying the rear and front support assemblies 102, 104 to the corner panels 50', 50".

Although any number of materials can be used to fabricate the components of corner seat assembly 74', it is contemplated that materials impervious to water, and unaffected by chemicals and minerals normally found in soap and water would be preferable. In one embodiment, metal and/or plastic products can be used. Furthermore, nonmetallic materials such as Teflon®, nylon, Delrin, Torlon®, Peek, Vespel®, or G10 are examples of nonmetallic materials that may render suitable performance. Of course, other materials may also be suitable.

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. A sub-assembly of a shower system, wherein the sub-assembly is attached to a pair of enclosure panels, wherein the pair of enclosure panels are arranged to form an enclosed, inner corner of the shower system, the sub-assembly comprising:

a corner seat platform having an upper surface and a lower surface, wherein the corner seat platform further includes:

a first seat passage, and a second seat passage, wherein each of the first and second seat passages extend through the corner seat platform member from the upper surface to the lower surface;

a rearwardly lower surface seat support assembly attached to the lower surface of the corner seat platform; and a forwardly lower surface seat support assembly attached to the lower surface of the corner seat platform, wherein each of the rearwardly lower surface seat support assembly and the forwardly lower surface seat support assembly includes:

a brace member including a first end and a second end, a first mounting post at least partially telescopically received within first end of the brace member, and a second mounting post at least partially telescopically received within the second end of the brace member, wherein the brace member further includes:

a first brace passage proximate the first end, and a second brace passage proximate the second end, wherein the first mounting post includes:

a first mounting post passage, wherein the second mounting post includes:

a second mounting post passage, wherein the first brace passage and the first mounting post passage are aligned with the first seat passage, wherein the second brace passage and the second mounting post passage are aligned with the second seat passage.

2. The shower system of claim 1 further including a first side support assembly; and a second side support assembly, wherein the first side support assembly attaches a first end of each the rearwardly lower surface seat support assembly and the forwardly lower surface seat support assembly to a first enclosure panel of the pair of enclosure panels, wherein the second side support assembly attaches a second end of the rearwardly lower surface seat support assembly and the forwardly lower surface seat support assembly to a second enclosure panel of the pair of enclosure panels.

3. The shower system of claim 2, wherein each of the first and second side support assemblies include an inside plate including a first end portion and a second end portion, wherein the first end portion of the inside plate includes first passage, wherein the second end portion of the inside plate includes a second passage, and an outside plate including a first end portion and a second end portion, wherein the first end portion of the outside plate includes first fastener passage, wherein the second end portion of the outside plate includes a second fastener passage, wherein the inside plate of the first side support assembly is located substantially adjacent an interior surface of the first enclosure panel of the pair of enclosure panels, wherein the outside plate of the first side support assembly is located substantially adjacent an exterior surface of the first enclosure panel of the pair of enclosure panels, wherein the inside plate of the second side support assembly is located substantially adjacent an interior surface of the second enclosure panel of the pair of enclosure panels, wherein the outside plate of the second side support assembly is located substantially adjacent an exterior surface of the second enclosure panel of the pair of enclosure panels.

4. The shower system of claim 3, wherein the first side support assembly includes a first insert disposed within a first bore foamed in the first enclosure panel, a second insert disposed within a second bore formed in the first enclosure panel, wherein the second side support assembly includes a first insert disposed within a first bore formed in the second enclosure panel, a second insert disposed within a second bore formed in the second enclosure panel, wherein the first and second inserts of each of the first and second side support assemblies include passage that permits the first fastener passage of the outside plate to be in communication with the first passage of the inside plate and the second fastener passage of the outside plate to be in communication with the second passage of the inside plate.

5. The shower system of claim 4, wherein at least a portion of an enclosure-panel-facing-end of the first mounting post of the rearwardly lower surface seat support assembly is extended through the first passage of the first end portion of the inside plate of the first side support assembly and further at least partially into the passage of the first insert disposed within the first bore formed in the first enclosure panel, wherein at least a portion of an enclosure-panel-facing-end of the first mounting post of the forwardly lower surface seat support assembly is extended through the second passage of the second end portion of the inside plate of the first side support assembly and further at least partially into the passage of the second insert disposed within the second bore formed in the first enclosure panel, wherein at least a portion of an enclosure-panel-facing-end of the second mounting post of the rearwardly lower surface seat support assembly is extended through the first passage of the first end portion of the inside plate of the second side support assembly and further at least partially into the passage of the first insert disposed within the first bore formed in the second enclosure panel, wherein at least a portion of an enclosure-panel-facing-end of the second mounting post of the forwardly lower surface seat support assembly is extended through the second passage of the second end portion of the inside plate of the second side support assembly and further at least partially into the passage of the second insert disposed within the second bore formed in the second enclosure panel.

6. The shower system of claim 3 further including a first fastener-receiving passage formed in an enclosure-panel-facing-end of the first mounting post of the rearwardly lower surface seat support assembly, a second fastener-receiving passage formed in an enclosure-panel-facing-end of the first mounting post of the forwardly lower surface seat support assembly, a third fastener-receiving passage formed in an enclosure-panel-facing-end of the second mounting post of the rearwardly lower surface seat support assembly, and a fourth fastener-receiving passage formed in an enclosure-panel-facing-end of the second mounting post of the forwardly lower surface seat support assembly.

7. The shower system of claim 6 further including a first fastener extending through:

the first fastener passage formed in the first end portion of the outside plate of the first side support assembly, the passage of the first insert disposed within a first bore formed in the first enclosure panel, the first passage formed in the first end portion of the inside plate of the first side support assembly, and the first fastener-receiving passage formed in the enclosure-panel-facing-end of the first mounting post of the rearwardly lower surface seat support assembly, a second fastener extending through:

the second fastener passage formed in the second end portion of the outside plate of the first side support assembly, the passage of the second insert disposed within a second bore formed in the first enclosure panel, the second passage formed in the second end portion of the inside plate of the first side support assembly, and the second fastener-receiving passage formed in the enclosure-panel-facing-end of the first mounting post of the forwardly lower surface seat support assembly, a third fastener extending through:

the first fastener passage formed in the first end portion of the outside plate of the second side support assembly, the passage of the first insert disposed within a first bore formed in the second enclosure panel, the first passage formed in the first end portion of the inside plate of the second side support assembly, and the third fastener-receiving passage formed in an enclosure-panel-facing-end of the second mounting post of the rearwardly lower surface seat support assembly, and a fourth fastener extending through:

the second fastener passage formed in the second end portion of the outside plate of the second side support assembly, the passage of the second insert disposed within a second bore formed in the second enclosure panel, the second passage formed in the second end portion of the inside plate of the second side support assembly, and the fourth fastener-receiving passage formed in the enclosure-panel-facing-end of the second mounting post of the forwardly lower surface seat support assembly.

8. The shower system of claim 4, wherein each of the first and second inserts include an outer circular cylindrical surface geometry.

9. The shower system of claim 1, wherein at least one of said panels is comprised of float glass.

10. The shower system of claim 9, wherein said float glass is greater than or equal to one-quarter inches thick but not greater than one-half inches thick.

11. The shower system of claim 9, wherein at least a portion of a surface of one of the float glass panels is coated.

12. The shower system of claim 11, wherein the coating includes at least one of a paint or a ceramic frit.

13. The shower system of claim 1, wherein said corner seat platform is arranged in a suspended orientation relative to the pair of enclosure panels.

14. The shower system of claim 13, further including inserts adapted to engage openings in said two or more glass panels, and also adapted to engage at least one seat support, wherein the at least one seat support is supported by the two or more glass panels, and only by the two or more glass panels.

15. A shower system comprising:

a configurable enclosure including two or more glass panels;

a splash panel module including at least one piece of shower hardware;

a basin having a first channel sized to receive a lower edge of the two or more glass panels and the splash panel module and a second channel positioned inward of the first channel in the shower area, the second channel adapted to collect water run-off from the configurable enclosure and a top surface of the basin, a corner seat platform at least indirectly supported by said two or more glass panels, wherein said two or more glass panels are arranged to form an enclosed inner corner of the shower system, wherein the corner seat platform includes:

an upper surface;

a lower surface;

a first seat passage, and a second seat passage, wherein each of the first and second seat passages extend through the corner seat platform member from the upper surface to the lower surface;

a rearwardly lower surface seat support assembly attached to the lower surface of the corner seat platform; and a forwardly lower surface seat support assembly attached to the lower surface of the corner seat platform, wherein each of the rearwardly lower surface seat support assembly and the forwardly lower surface seat support assembly includes:

a brace member including a first end and a second end, a first mounting post at least partially telescopically received within first end of the brace member, and a second mounting post at least partially telescopically received within the second end of the brace member, wherein the brace member further includes:

a first brace passage proximate the first end, and a second brace passage proximate the second end, wherein the first mounting post includes:

a first mounting post passage, wherein the second mounting post includes:

a second mounting post passage, wherein the first brace passage and the first mounting post passage are aligned with the first seat passage, wherein the second brace passage and the second mounting post passage are aligned with the second seat passage.

16. The shower system of claim 1, further including a first fastener and a second fastener that joins the corner seat platform to the rearwardly lower surface seat support assembly and the forwardly lower surface seat support assembly, wherein the first fastener extends through:

the first seat passage, the first brace passage and the first mounting post passage, wherein the second fastener extends through:

the second seat passage, the second brace passage and the second mounting post passage.

* * * * *